US005400466A

United States Patent [19]

Alderman et al.

[11] Patent Number: 5,400,466

[45] Date of Patent: Mar. 28, 1995

[54] VACUUM CLEANER WITH AIR VIBRATION SUCTION NOZZLE

[76] Inventors: Robert J. Alderman, P.O. Box 1937, Ruskin, Fla. 33570; James E. Taylor, Rte. 3, Box 736, Sequin, Tex. 78155

[21] Appl. No.: 104,878

[22] Filed: Aug. 10, 1993

[51] Int. Cl.[6] ..... A47L 5/30

[52] U.S. Cl. ..... 15/363; 15/404

[58] Field of Search ..... 15/363, 404

[56] References Cited

U.S. PATENT DOCUMENTS

| | | | |
|---|---|---|---|
| 2,558,496 | 6/1951 | Reeves | 15/377 |
| 2,932,054 | 4/1960 | Lichtgarn | 15/104 X |
| 3,750,221 | 8/1973 | Meyerhoefer | 15/404 |
| 3,813,726 | 6/1974 | Kowalewski | 15/385 |
| 4,207,650 | 6/1980 | Crise | 15/404 |
| 4,364,147 | 12/1982 | Biedermann et al. | 15/404 |
| 4,677,704 | 7/1987 | Huggins | 15/404 X |
| 5,201,877 | 4/1993 | Relin et al. | 15/404 X |

*Primary Examiner*—Christopher K. Moore
*Attorney, Agent, or Firm*—Hopkins & Thomas

[57] ABSTRACT

A vacuum cleaner with an air vibration suction nozzle for application to a workpiece, whereby air vibrations produced by a transducer supported and sealed in the nozzle housing vibrate the workpiece, or debris with respect to the workpiece, and any loose particles on the workpiece are then drawn into the vacuum cleaner through the suction nozzle. The suction nozzle is provided with an elongated nozzle opening, a plurality of wheels to guide the nozzle over the workpiece, a stationary brush adjacent the nozzle opening, and a viewport and interior light for illuminating and viewing the workpiece through the nozzle opening. Controls for adjusting both the frequency and amplitude of the airwaves produced by the transducer are also provided. The suction nozzle can also be fitted with a plurality of air holes disposed within the nozzle housing adjacent the nozzle opening, which openings can be selectively opened or closed, and a suction nozzle can be constructed to slidably engage upon the workpiece without the use of wheels.

37 Claims, 3 Drawing Sheets

VACUUM CLEANER WITH AIR VIBRATION SUCTION NOZZLE

FIELD OF THE INVENTION

The present invention relates in general to an apparatus for vacuum cleaning debris located in or on a workpiece in either a commercial, industrial or residential setting. More particularly, the invention relates to a vacuum cleaner with an air vibration suction nozzle whereby air vibrations emitted from a transducer supported within the nozzle housing vibrate either the workpiece and/or debris located on the workpiece in order to remove the debris from the workpiece in a vacuum induced airstream.

BACKGROUND OF THE INVENTION

Vacuum cleaners are well known and well developed in the prior art. Many attempts have been made previously to create a vacuum cleaner with a suction nozzle capable of cleaning debris located in or on carpeting or other fabric surfaces utilizing a mechanical beating or agitation system such as a rotary brush for dislodging the debris located on the workpiece to be cleaned. There are, however, two inherent disadvantages in a system which mechanically beats the surface to be cleaned. The first of these is that the physical agitation, brushing or beating of the workpiece results in wear upon the workpiece diminishing its appearance and useful life and results in early replacement of the workpiece, and in the mechanical wear of the agitation, brushing or beating apparatus typically located within the suction nozzle housing, thus necessitating repair or replacement.

U.S. Pat. No. 2,558,496 issued to Reeves discloses a mechanical agitator in the form of a brush located in the nozzle inlet of a vacuum cleaner suction nozzle, driven by a hydraulic motor. U.S. Pat. No. 3,813,726 of Kowalewski discloses a vacuum cleaner suction nozzle for use with deep pile shag carpeting containing an agitator in direct contact with the carpet to be vacuumed, driven by an electric motor through a reduction gear assembly.

U.S. Pat. No. 3,750,221 of Meyerhoefer discloses a vacuum cleaner suction nozzle having a vibrator for creating pulsations in the airstream disposed in the throat portion of an air passageway in a suction nozzle. In Meyerhoefer this vibratory member resonates apparently at a prescribed frequency based upon the speed of the airflow moving through the suction nozzle in combination with the properties of the vibrating member. Meyerhoefer does not disclose a mechanical agitator in direct physical contact with the carpeting, however it does disclose a beating mechanism for creating pulsations in the airstream, which mechanism will eventually need to be maintained or replaced in the course of normal operation. Moreover Meyerhoefer does not make provision for adjusting the frequency of its vibrator in operation. Also, Meyerhoefer provides no apparent means for increasing or decreasing the amplitude of the airwaves created by the beating mechanism. Finally, Meyerhoefer provides a vibrator located directly in the airstream, which therefore impedes the airstream and is susceptible to failure should dirt or any other objects obstruct the narrow portion of the air passageway about the vibrator.

None of the known prior art disclose a vacuum cleaner with an air vibration suction nozzle for agitating the workpiece to be cleaned and that contains no moving parts directly in the airstream, and provides a control mechanism for adjusting not only the frequency, but also the amplitude of the airwaves being generated for the purposes of agitating either the workpiece, and/or the debris to be vacuumed. The preferred embodiment described and as claimed below makes provision for agitating either the workpiece and/or debris located in or on the workpiece, depending upon the resident frequency of the object to be vibrated, as well as controls for selecting the frequency to be utilized in agitating the workpiece, and adjusting the amplitude of the airwaves produced by the air vibrating means, coupled with a viewport into the nozzle housing upon the portion of the workpiece to be cleaned, illuminated so that the vacuum cleaner and its suction nozzle can be fine tuned to the task at hand.

SUMMARY OF THE INVENTION

Briefly described, the present invention comprises an apparatus for cleaning debris from, on, or about a workpiece through the use of a vacuum cleaner in combination with an air vibration suction nozzle which utilizes airwaves to vibrate either the workpiece, and/or the debris located in or on the workpiece, in order to separate and remove debris from the workpiece without any physical contact by the vibrator with the workpiece, or the need for any mechanical brush, agitator or beater mechanism located in the vacuum cleaner or air vibration suction nozzle air passageways for accomplishing this task.

The vacuum cleaner with air vibration suction nozzle comprises a vacuum cleaner suction nozzle housing having a nozzle opening defined within the housing for application to the workpiece, and an exhaust opening into and through which the debris cleaned from the workpiece is removed to a vacuum cleaner having a conventional dust and dirt collection apparatus. A transducer is supported within the nozzle housing for producing airwaves directed through said nozzle opening and toward the workpiece, coupled with a control circuit for adjusting the frequency of the airwaves produced by the transducer so that the frequency of the airwaves is adapted to the workpiece or debris to be cleaned, such that either the workpiece and/or the debris is vibrated and the debris moves with respect to the workpiece and can be readily entrained in the airstream and moved through the nozzle housing into the vacuum cleaner's dust collection system. Thus, a feature of the preferred embodiment is the ability to adjust the airwaves produced by the air vibration suction nozzle to either the workpiece or debris to be cleaned from about the workpiece without utilizing any mechanical system which comes in contact with the workpiece.

From a more detailed aspect, the vacuum cleaner suction nozzle of the preferred embodiment comprises an elongated nozzle opening transverse to the usual direction of movement of the nozzle housing within the nozzle housing for placement adjacent the workpiece, and a blower, or vacuum, assembly for drawing an airstream from about the workpiece connected to the nozzle by flexible conduit means extending from the inlet of the blower housing to a nozzle handle connected to the exhaust opening of the nozzle housing.

In addition to the elongated opening within the nozzle housing, there can also be provided a plurality of small air inlet openings disposed in the nozzle housing about the nozzle opening, of sizes smaller than the nozzle opening, with a control plate or other similar mechanism for selectively opening and closing the smaller air inlet openings so that a greater or lesser amount of air can be permitted to enter the suction nozzle, thereby controlling the amount of debris which can be removed from the workpiece, or for allowing use of the larger nozzle opening in direct contact with a fabric or carpeted surfaces which would otherwise restrict the entrance of air into the nozzle opening.

The air vibrations of the stream of air moving through the vacuum cleaner suction nozzle are produced by a transducer which comprises an electrical speaker for producing airwaves usually between 10 to 500 cycles per second. Coupled with the transducer is a control circuit for adjusting the frequency of the airwaves in a range from 10 hertz to 500 hertz. A control circuit for adjusting the amplitude of the airwaves is also provided.

The vacuum cleaner further comprises a shield for the transducer within the nozzle housing whereby the transducer is protected from both the airstream and debris cleaned from the workpiece moving through the nozzle housing. A viewport is defined within the nozzle housing, and an interior light for illuminating the workpiece can be mounted adjacent the nozzle opening of the nozzle housing, so that both the frequency and amplitude of the airwaves produced by the transducer can be adjusted to the fabric or debris to be cleaned from the workpiece through visual inspection and fine tuning to achieve maximum vibration of either the workpiece or the debris.

In an alternate version of the preferred embodiment, the edges of the suction nozzle housing are constructed to provide for slidably engaging the nozzle housing directly upon the workpiece. In this version of the preferred embodiment the air holes disposed in the nozzle housing about the nozzle opening and adjacent the workpiece would be used to assist in introducing air into the nozzle housing.

Lastly, the vacuum cleaner may have a switch for turning the transducer on and off independently of the operation of the vacuum cleaner blower assembly so that the suction nozzle can be utilized on both carpeted or fabric covered surfaces, as well as on hardwood or tile floors, thus enhancing the versatility of the vacuum cleaner and the air vibration suction nozzle for use upon more than one type of workpiece in marked contrast to prior art.

Therefore, it is an object of the present invention to provide a vacuum cleaner with an air vibration suction nozzle which contains no motors, belts, or rotary systems for agitating the workpiece to be vacuumed by the vacuum cleaner.

Another object of the present invention is to provide a vacuum cleaner which is less damaging to carpets and other fabric workpieces by using air vibrations in the airstream produced by a transducer to gently vibrate the workpiece in place and remove dirt and soil particles from the workpiece without beating, pulling, or tearing at the fabric of the workpiece.

It is another object of the present invention to provide a vacuum cleaner which includes an airstream vibrator that can match the frequency and amplitude of the waves produced in the airstream to the workpiece, or to the debris located in the workpiece being cleaned, in order to more efficiently clean the workpiece.

It is a further object of the present invention is to provide a vacuum cleaner which will clean a workpiece with greater efficiency than a mechanical system in that a power circuit is utilized to create airwaves produced in the airstream of the vacuum cleaner to vibrate the workpiece, which can be done more efficiently, and with less power loss, than is believed possible through a mechanical system.

It is still another object of the present invention to provide a vacuum cleaner with a suction nozzle which can be quieter in operation than a mechanical agitation suction nozzle.

Other objects, features and advantages of the invention will become apparent upon reading the specification when take in conjunction with the accompanying drawings.

DETAILED DESCRIPTION OF THE PREFERRED EMBODIMENT

Figure 1:
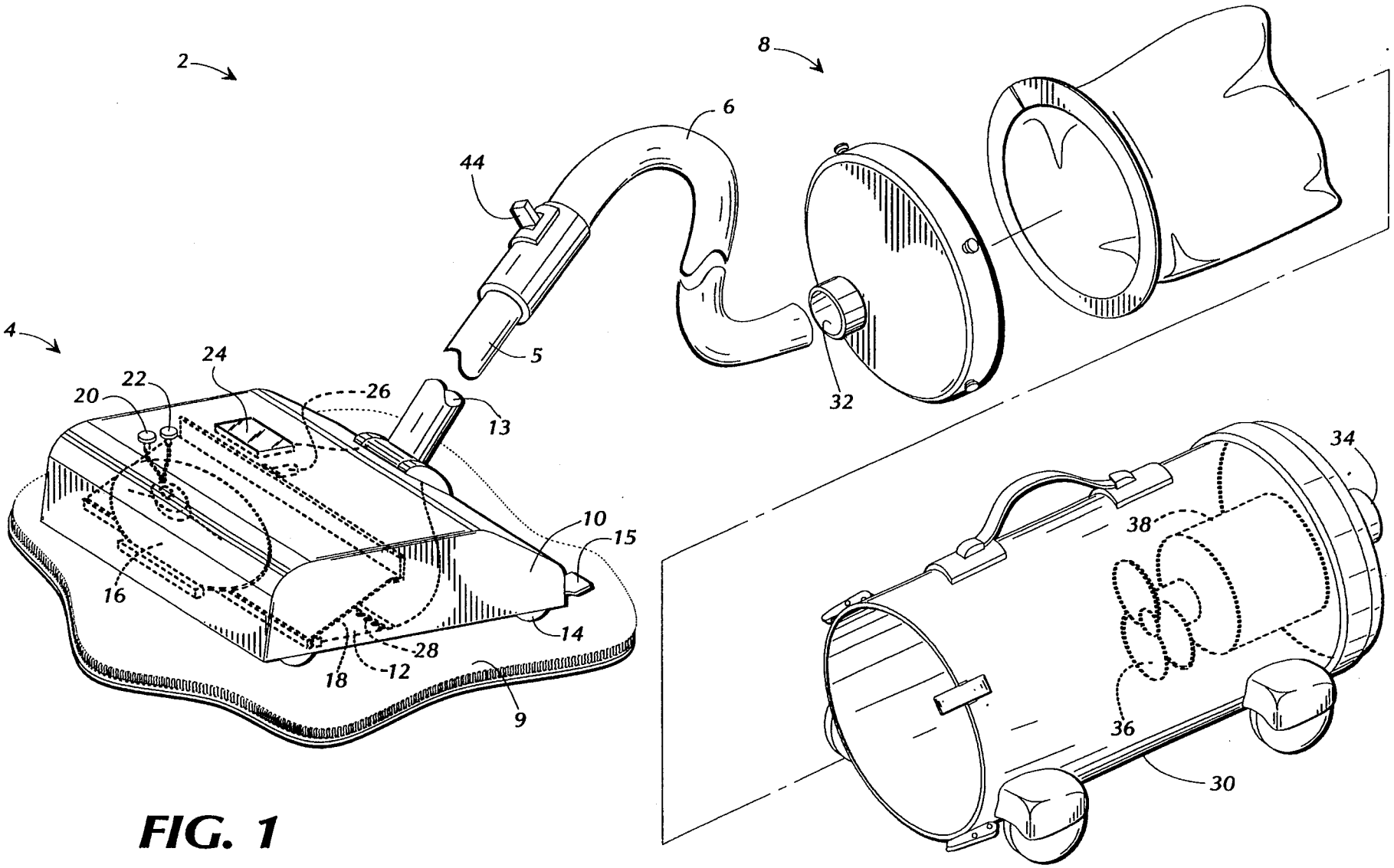
FIG. 1 is a perspective view of a vacuum cleaner with an air vibration suction nozzle according to a form of the preferred embodiment.
Figure 2:
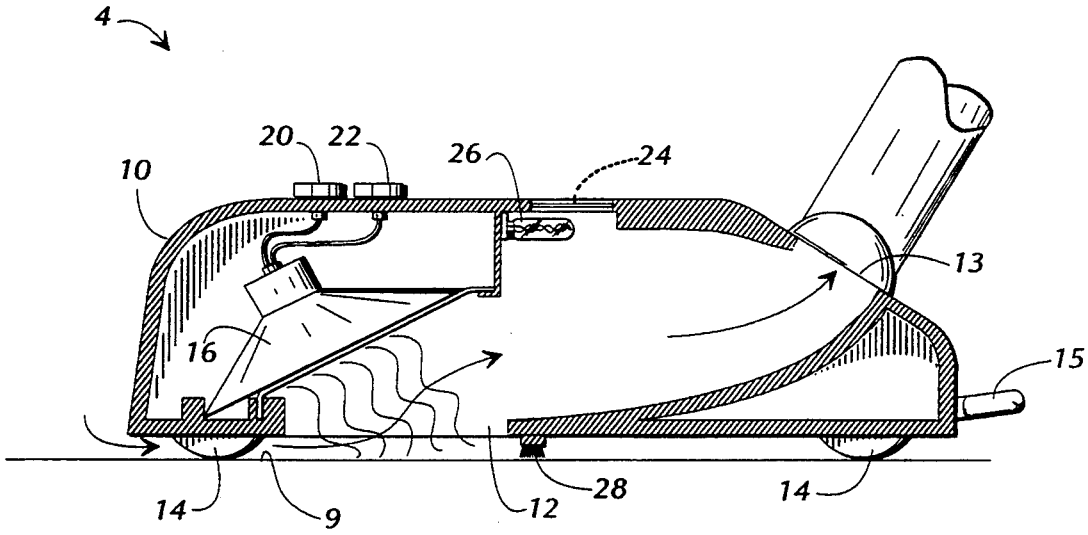
FIG. 2 is a side elevation view of the nozzle housing illustrated in FIG. 1, illustrating how the nozzle housing and transducer are supported over the workpiece.
Figure 3:
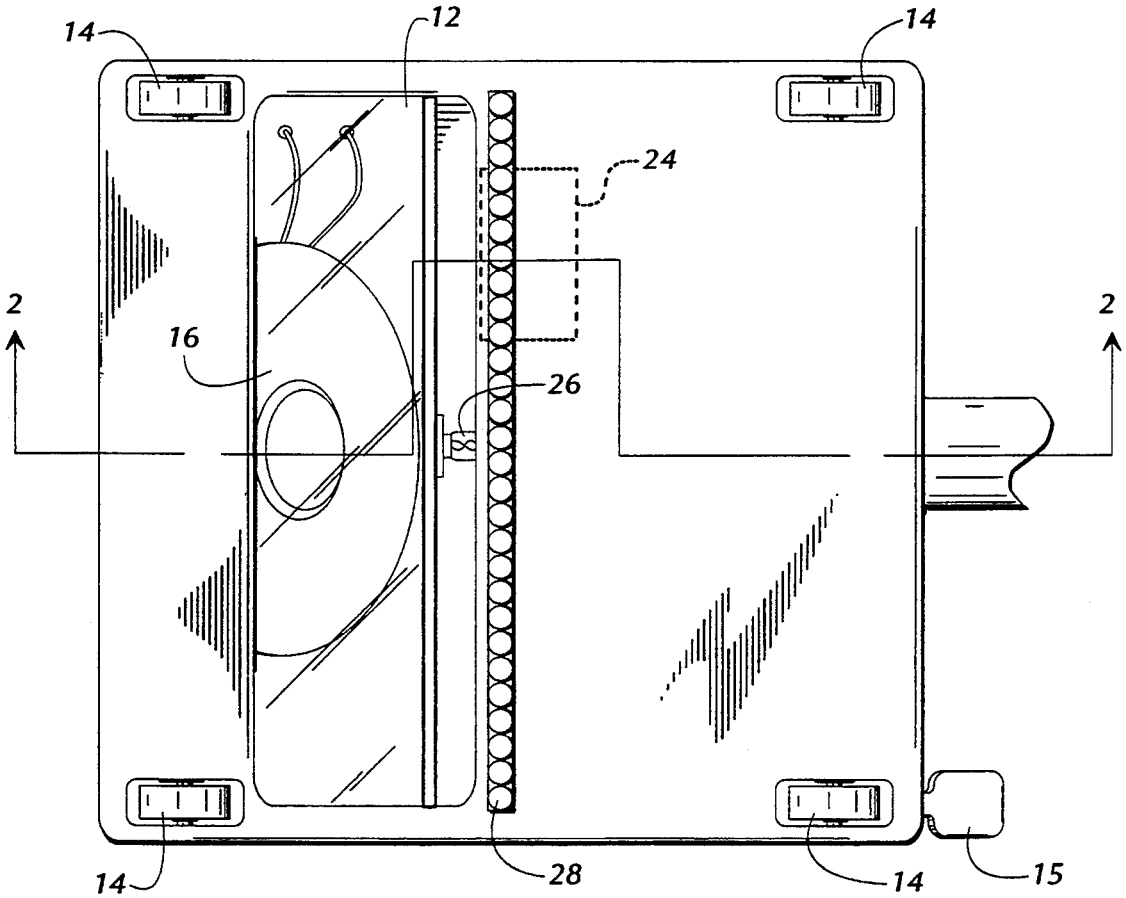
FIG. 3 is a bottom plan view of the nozzle housing illustrated in FIG. 1.

Referring now in more detail to the drawings, in which like reference numerals indicate like parts throughout the several views, FIGS. 1 through 3 show a preferred embodiment of the present invention comprising a vacuum cleaner 2 including nozzle 4 connected by nozzle handle 5 and vacuum cleaner hose 6 to blower assembly 8, whereby nozzle 4 is applied upon workpiece 9 in order to clean debris from the workpiece. Nozzle 4 conventionally comprises nozzle housing 10 including nozzle opening 12 defined within the lower surface of nozzle housing 10 adjacent workpiece 9, exhaust opening 13 through which debris cleaned from the workpiece is removed from nozzle housing 10, and a plurality of wheels 14 supporting nozzle housing 10 adjacent workpiece 9. Nozzle housing 10 can be moved vertically above workpiece 9 through the use of height adjustment mechanism 15 for raising and lowering nozzle housing 10 with respect to workpiece 9. Nozzle housing 10 can be constructed of any conventional material to include metal or plastic, and may also contain a foam or foam rubber lining for insulating nozzle housing 10 from the air wave vibrations created by speaker 16 supported within nozzle housing 10.

Referring now to FIG. 2, Speaker 16 is supported within nozzle housing 10 and is protected from the airstream containing debris removed from workpiece 9 by shield 18, wherein shield 18 is comprised of an acoustically transparent material substantially impervious to dust mounted upon and substantially sealing speaker 16 from the debris to be cleaned from workpiece 9. Speaker 16 is a solid state power circuit comprising a frequency generator and an amplifier capable of producing up to 100 watts of power, thus avoiding problems such as mechanical wear and failure typically associated with a mechanical frequency generator or vibrator.

Shield 18 can be constructed of any durable material, such as polypropylene, which is both acoustically transparent to sound waves, and is substantially impervious to the debris to be cleaned from workpiece 9 by nozzle 4 in conjunction with blower assembly 8. It is also possible that speaker 16 can be completely sealed by shield 18 in water-tight fashion, such that nozzle 4 could be applied to not only a dry workpiece, but also to a damp workpiece such as wet carpeting or fabric covered surfaces and could function in much the same fashion as a wet-dry shop vacuum cleaner, or carpet cleaning machine.

Referring now again to FIGS. 1 and 2, mounted upon the exterior of nozzle housing 10 is frequency control knob 20 which is adapted to select a range of frequencies from 10 hertz to 500 hertz for speaker 16. Similarly, mounted upon nozzle housing 10 is amplitude control knob 22 for selecting the amplitude, analogous to a power or volume setting, for the air wave vibrations created by speaker 16. Frequency control knob 20 and amplitude control knob 22 can also be located upon blower housing 30, or in the alternative, upon nozzle handle 5 A window is defined within nozzle housing 10 comprising viewport 24 having transparent sheet material closing said viewport for visually exposing the interior of the nozzle assembly and workpiece 9 through nozzle assembly 12. Also located within nozzle housing 10 is interior light 26 for illuminating workpiece 9 through nozzle opening 12, so that said workpiece can be viewed through viewport 24. Nozzle housing 10 may also be provided with brush 28 disposed within the bottom of nozzle housing 10 in slidable engagement with workpiece 9.

In operation, the frequency emitted by speaker 16 in creating the airwaves directed to workpiece 9 through nozzle opening 12 will sound to the layman as a low or barely audible hum once the frequency has been adjusted to exceed 20 hertz. It is anticipated that lower frequencies in the range of 10 hertz to 200 hertz will be used to vibrate carpeted or fabric covered surfaces to be vacuumed, and that higher frequencies in the range of 200 hertz to 500 hertz will be used to vibrate smaller dirt particles and debris to be vacuumed from hard surfaces such as wood or tile flooring. In operation the frequency and/or amplitude selected for vacuuming the workpiece will be adjusted for each particular use.

The frequency used on the workpiece will be set through frequency control knob 20. The amplitude of speaker 16, adjusted through amplitude control knob 22, will raise or lower the volume of the airwaves created by speaker 16. During operation the person operating vacuum cleaner 2 will apply nozzle 4 to workpiece 9, inspecting workpiece 9 through viewport 24 illuminated by interior fight 26 in nozzle opening 12, and will utilize frequency knob 20, and amplitude control knob 22 to maximize the vibration of either workpiece 9, or the vibration of the dirt located in or about workpiece 9 for the vacuuming process. Through experience, the operator of vacuum cleaner 2 will learn to recognize certain frequency and amplitude combinations as being most applicable to the task at hand in conjunction with the debris to be removed from workpiece 9.

As shown in FIG. 1, blower assembly 8 comprises a blower housing 30 having an air inlet 32, an air outlet 34, with a blower fan 36 driven by blower motor 38 disposed within said blower housing 30. Those familiar with the art will recognize that a conventional blower assembly 8 comprises a canister or upright vacuum cleaner, and that blower housing 30 typically will contain a means for collecting the dirt and debris removed by nozzle 4 from workpiece 9. Nozzle 4 is connected by nozzle handle 5 and vacuum cleaner hose 6 running from exhaust opening 13 of nozzle 4 to air inlet 32 of blower housing 30. Nozzle handle 5 may be conventionally constructed of a durable material such as metal or plastic, and may be configured as a conduit upon which a plastic handle insulated from said nozzle handle is mounted, upon which switch 44 may also be mounted for turning the power to speaker 16 off and on. Frequency control knob 20, and amplitude control knob 22 are mounted upon nozzle handle 5 in conjunction with switch 44. Power for speaker 16 will typically come from blower housing 30 through means of an electrical fine running from blower motor 38 through blower housing 30, along vacuum hose 6 and nozzle handle 5 into nozzle housing 10, and into connection with the solid state circuit powering speaker 16.

Figure 4:
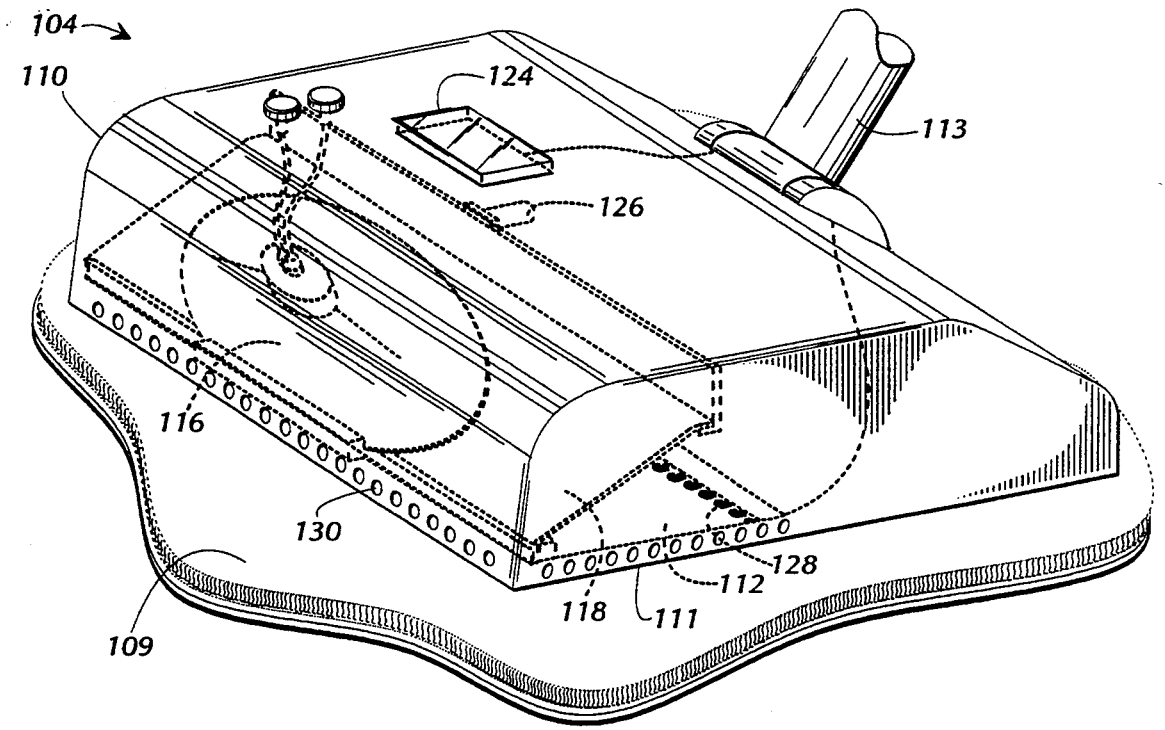
FIG. 4 is a perspective view of an alternate version of the nozzle housing of the preferred embodiment.
Figure 5:
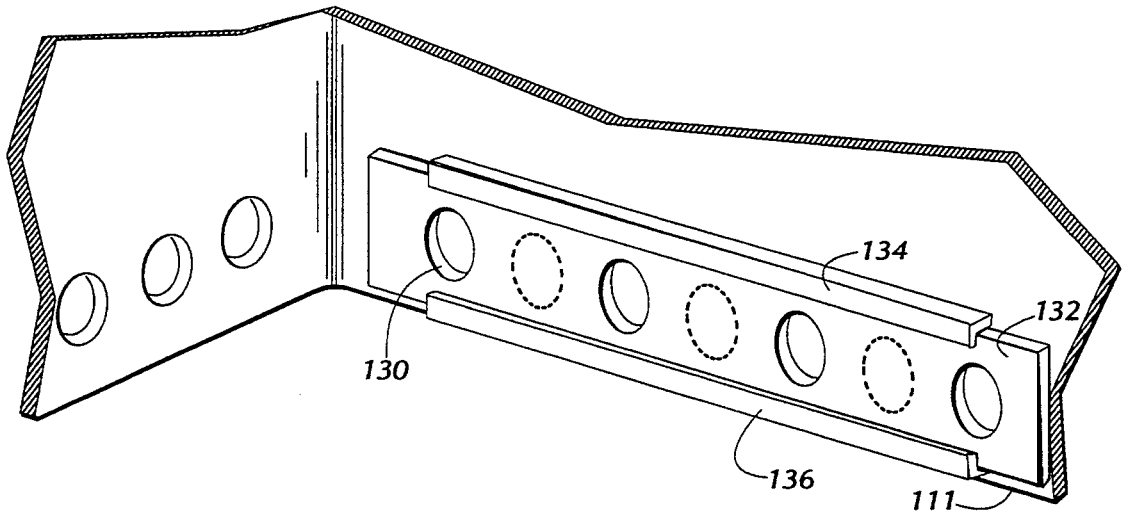
FIG. 5 is a partial cut away perspective view from within the nozzle housing illustrated in FIG. 4, illustrating the air holes disposed within the nozzle housing adjacent the workpiece and the control plate for these air holes.

An alternate version of the preferred embodiment is illustrated in FIGS. 4 and 5 whereby nozzle 104 is applied to workpiece 109 for vacuuming debris located on or about said workpiece. Nozzle 104 is comprised of nozzle housing 110, supported above workpiece 109 on nozzle edge 111, having nozzle opening 112 disposed in nozzle housing 110 adjacent workpiece 109. Nozzle housing 110 may be constructed of any durable material, and may also contain foam or foam rubber insulation for insulating nozzle housing 110 from the airwaves created by speaker 116. Speaker 116 is supported within nozzle housing 110, and is shielded from the debris removed from workpiece 109 by shield 118 comprised of an acoustically transparent material substantially impervious to dust mounted upon and substantially sealing speaker 116 from the debris cleaned from workpiece 109.

Nozzle housing 110 includes viewport 124 disposed within nozzle housing 110 with transparent sheet material closing viewport 124 for visually exposing workpiece 109 through nozzle opening 112, interior light 126 for illuminating workpiece 109 through nozzle opening 112, and may also be fitted with brush 128 aligned parallel to nozzle opening 112 for sweeping any large particles of dirt or debris which have not otherwise been taken into nozzle opening 112.

As best illustrated in FIG. 5, a plurality of air inlet openings 130 extend through nozzle housing 110, where it is shown that a number of small air inlet openings 130 are disposed within nozzle edge 111 adjacent nozzle opening 112 and may be opened and closed through the use of a control plate 132. Control plate 132 is fabricated of any conventional material such as metal or plastic, which may be manually or automatically moved to open and close air inlet openings 130 whereby air would be taken into housing 110 through air inlet openings 130 into nozzle opening 112, and thus assist in the vacuuming process of removing debris from workpiece 109 with the stream of air moving from the surface of the workpiece into the nozzle housing. Control plate 132 is held in slidable engagement with nozzle housing 110 by two sliding tracks, upper track 134, and lower track 136. Those familiar with the art will recognize that control plate 132, upper track 134, and lower track 136 may comprise one continuous, or any number of control plates and sliding tracks adapted to open and close all or a portion of air inlet openings 130 disposed within nozzle housing 110.

In operation, the alternate preferred embodiment illustrated in FIG. 4 would rest directly upon workpiece 109, supported on nozzle edge 111. Nozzle 104 would be directed across workpiece 109 so that speaker 116 would gently vibrate either workpiece 109, or the debris within workpiece 109, whereby the dirt and debris dislodged from workpiece 109 would be drawn in combination with air taken in through air inlet opening 130 and through nozzle opening 112 into and through exhaust opening 113 into blower assembly 8, not illustrated in FIG. 4. As with the version of the preferred embodiment best shown in FIGS. 1 through 3, the alternate version of the preferred embodiment disclosed in FIG. 4 would also contain a frequency control knob 20 and amplitude control knob 22 which could be mounted upon either nozzle housing 110, blower assembly 8, or nozzle handle 5.

It is envisioned that the alternate version of the preferred embodiment could be fabricated in any number of configurations, including a small hand held unit, which could be utilized in direct application upon not only carpet or fabric flooring, but also upon the fabric portions of furniture, as well as upon draperies and any tapestries or fabric wall hangings in need of cleaning, and could also be placed in direct contact upon clothing for removing dust and lint from clothing without having to use a brush or comb which would otherwise tear or snag the clothing from which the dirt is being removed.

Thus, it can be seen that the present invention comprises a useful and effective method and apparatus for cleaning debris from a workpiece capable of being adapted to any number of uses. While the invention has been shown and described as what is presently believed to be the most practical and preferred embodiments thereof, it will be apparent that modifications and variations within the scope and spirit of the invention are possible, and that the invention is to be afforded the broadest interpretation so as to encompass all of the equivalents thereof, without departing from the spirit and scope of the invention as set forth in the following claims.

We claim:

1. A vacuum cleaner for cleaning debris from a workpiece, comprising:

a nozzle housing including a nozzle opening for application to the workpiece, and an exhaust opening;

means for drawing an airstream from about the workpiece through said nozzle opening into said housing and out of said exhaust opening when said nozzle housing is applied to the workpiece;

transducer means supported by said nozzle housing for producing airwaves directed through said nozzle opening and toward the workpiece;

means for adjusting the frequency and amplitude of the airwaves to a frequency and amplitude adapted to vibrate the workpiece and the debris with respect to each other;

whereby vibrating air produced by the transducer means tends to vibrate the workpiece and any loose particles in the workpiece with respect to each other and the loose particles on the workpiece tend to move with respect to the workpiece and are drawn by the airstream away from the workpiece.

2. The vacuum cleaner of claim 1, wherein said nozzle opening in said nozzle housing comprises an elongated opening for placement adjacent the workpiece, and guide means mounted on said housing for moving said housing with respect to the workpiece, with said elongated opening moving transverse of its length with respect to the workpiece.

3. The vacuum cleaner of claim 2, wherein said means for drawing an airstream from about the workpiece through said opening into said nozzle housing comprises a blower housing, an air inlet and an air outlet, a blower means mounted in said blower housing, an electric motor for operating said blower means, and conduit means extending from the inlet of said blower housing to said exhaust opening of said nozzle housing.

4. The vacuum cleaner of claim 3, further comprising switch means for turning said transducer means on and off independently of the operation of said blower means.

5. The vacuum cleaner of claim 2, wherein said guide means comprise a plurality of wheels mounted to said nozzle for contacting the workpiece.

6. The vacuum cleaner of claim 5 further comprising means for adjusting the position of said wheels with respect to said nozzle housing for changing the distance between said nozzle housing and the workpiece.

7. The vacuum cleaner of claim 2, wherein said guide means comprise means for slidably engaging said nozzle housing directly upon the workpiece.

8. The vacuum cleaner of claim 1, and wherein said nozzle housing further includes a plurality of air inlet openings disposed in said nozzle housing adjacent said nozzle opening of sizes smaller than said nozzle opening.

9. The vacuum cleaner of claim 4, further comprising a means for selectively opening and closing said air inlet openings.

10. The vacuum cleaner of claim 1, wherein the transducer means comprises an electrical speaker for producing airwaves between 10 to 500 cycles per second.

11. The vacuum cleaner of claim 1, wherein said means for adjusting the frequency of said airwaves comprise means for selecting a frequency for said speaker ranging from 10 hertz to 500 hertz.

12. The vacuum cleaner of claim 1, wherein said means for adjusting the frequency of the airwaves produced by said transducer means are mounted externally of said nozzle housing.

13. The vacuum cleaner of claim 1, wherein said means for adjusting the amplitude of said airwaves are mounted externally of said nozzle housing.

14. The vacuum cleaner of claim 1, further comprising means to shield the transducer means from the airstream and debris cleaned from the workpiece.

15. The vacuum cleaner of claim 14, wherein said means to shield said transducer means comprise an acoustically transparent shield substantially impervious to dust mounted on and substantially sealing said transducer means from the debris to be cleaned from the workpiece.

16. The vacuum cleaner of claim 1, and wherein said nozzle housing includes window means for visually exposing through said housing the portion of the workpiece to which the nozzle opening is applied.

17. The vacuum cleaner of claim 16, and wherein said window means comprises a viewport formed in said housing and transparent sheet material closing said viewport for visually exposing the workpiece.

18. The vacuum cleaner of claim 17, further comprising means for illuminating the workpiece mounted within the nozzle housing and directed towards said nozzle opening.

19. The vacuum cleaner of claim 1, and further including brush means extending from said nozzle housing for engagement with the workpiece.

20. The vacuum cleaner of claim 19, wherein said brush means comprises a brush extending about said nozzle opening for slidable contact with the workpiece.

21. A vacuum cleaner for cleaning debris from a workpiece, comprising;

a nozzle housing including a nozzle opening for application to the workpiece and an exhaust opening:

means for drawing an airstream from about the workpiece through said nozzle opening into said housing and out of said exhaust opening when said nozzle housing is applied to the workpiece;

an electrical speaker mounted to said housing for producing airwaves directed through said nozzle opening and toward the workpiece:

means for adjusting the amplitude of the airwaves produced by said speaker; and means to shield said electrical speaker from the airstream and debris cleaned from the workpiece;

whereby vibrating air produced by the electrical speaker tends to vibrate the workpiece and loose particles in the workpiece with respect to each other and loose particles [on]in the workpiece tend to move with respect to the workpiece and are drawn by the airstream away from the workpiece.

22. The vacuum cleaner of claim 21, wherein said nozzle opening comprises an elongated opening with its longitudinal axis parallel to the leading transverse edge of said nozzle housing.

23. The vacuum cleaner of claim 22, wherein said speaker comprises an elongated speaker with its longitudinal axis parallel to the longitudinal axis of said nozzle opening.

24. The vacuum cleaner of claim 23, Wherein said speaker is shaped and constructed to focus said airwaves produced by said speaker towards the workpiece through said nozzle opening.

25. The vacuum cleaner of claim 24, further comprising means for adjusting the frequency of the airwaves produced by said speaker for selecting a frequency ranging from 10 hertz to 500 hertz.

26. The vacuum cleaner of claim 25, wherein said means for adjusting the amplitude of said airwaves are mounted externally of said nozzle housing.

27. The vacuum cleaner of claim 24, wherein said speaker is constructed and arranged to produce sound waves audible to the human ear.

28. A vacuum cleaner for cleaning debris from a workpiece having a suction nozzle housing including a nozzle opening for application to the workpiece and an exhaust opening, comprising:

transducer means supported by said housing for producing airwaves directed toward the workpiece; and means for adjusting the frequency of said airwaves to a frequency adapted to vibrate the workpiece to be cleaned.

29. The vacuum cleaner of claim 28, further comprising means for adjusting the amplitude of said air vibrating means.

30. A vacuum cleaner for cleaning debris from a workpiece having a suction nozzle housing including a nozzle opening for application to the workpiece and an exhaust opening, comprising:

transducer means supported by said housing for producing airwaves directed toward the workpiece; and means for adjusting the amplitude of said airwaves adapted to vibrate the workpiece to be cleaned.

31. The vacuum cleaner of claim 30, further comprising means for adjusting the frequency of said airwaves to a frequency adapted to vibrate the workpiece to be cleaned.

32. A vacuum cleaner for cleaning debris from a workpiece, comprising:

a nozzle housing including a nozzle opening for application to the workpiece, and an exhaust opening;

means for drawing an airstream from about the workpiece through said nozzle opening into said housing and out of said exhaust opening when said nozzle housing is applied to the workpiece;

transducer means supported by said housing for producing airwaves directed through said nozzle opening and toward the workpiece;

means for adjusting the frequency of said transducer means to produce airwaves having a frequency in the range of 10 to 500 cycles per second;

means to shield said transducer means from the airstream and debris cleaned from the workpiece;

whereby vibrating air produced by the transducer means tends to vibrate the workpiece and any loose particles in the workpiece, and any loose particles on the workpiece tend to move with respect to the workpiece and are drawn by the airstream away from the workpiece.

33. A vacuum cleaner for cleaning debris from a workpiece, comprising:

a nozzle housing including a nozzle opening for application to the workpiece and an exhaust opening;

a blower housing, an air inlet and an air outlet in said blower housing, blower means mounted in said blower housing, an electric motor for operating said blower means, and flexible conduit means extending from the inlet of said blower housing to said exhaust opening of said nozzle housing for drawing an airstream from about the workpiece through said nozzle opening;

transducer means supported by said nozzle housing for producing airwaves directed through said nozzle housing and said nozzle opening toward the workpiece;

means for adjusting the frequency of said transducer to produce airwaves between 10 to 500 cycles per second;

means for adjusting the amplitude of said airwaves;

an acoustically transparent shield substantially impervious to dust mounted upon and substantially sealing said transducer from the debris to be cleaned from the workpiece; and switch means for turning said transducer on and off independently of the operation of said blower means;

whereby vibrating air produced by the transducer means tends to vibrate the workpiece and any loose particles in the workpiece and any loose particles on the workpiece tend to move with respect to the workpiece and are drawn by the airstream produced by said blower means away from the workpiece.

34. A vacuum cleaner for cleaning debris from a workpiece, comprising:

a nozzle housing including a nozzle opening for application to the workpiece, and an exhaust opening;

means for drawing an air stream from about the workpiece through said nozzle opening into said housing and out of said exhaust opening when said nozzle opening is applied to the workpiece;

air vibrating means mounted to said nozzle housing for producing airwaves directed through said nozzle opening and toward the workpiece;

said housing including window means for visually exposing through said housing the portion of the workpiece to which the nozzle opening is applied.

35. The vacuum cleaner of claim 34, and wherein said window means comprises a viewport formed in said housing and transparent sheet material closing said viewport for visually exposing the workpiece.

36. The vacuum cleaner of claim 34, and further comprising means for illuminating the workpiece mounted within said nozzle housing.

37. The vacuum cleaner of claim 34, and further comprising means for adjusting the amplitude of said airwaves produced by said air vibrating means.

* * * * *